United States Patent [19]

Antonious

[11] 4,136,877

[45] Jan. 30, 1979

[54] GOLF CLUB ALIGNMENT SYSTEM

[76] Inventor: Anthony J. Antonious, 7005 Lachlan Cir., Baltimore, Md. 21239

[21] Appl. No.: 761,860

[22] Filed: Jan. 24, 1977

Related U.S. Application Data

[63] Continuation-in-part of Ser. No. 649,897, Jan. 16, 1976, abandoned.

[51] Int. Cl.[2] ..... A63B 53/04

[52] U.S. Cl. ..... 273/164; 273/183 D

[58] Field of Search ..... 273/77 R, 78, 163 R, 273/164, 167–175, 183 D, 193 R, 194 R, 194 A; 33/233, 258, 297; D34/5 GC, 5 GH; 116/DIG. 45

[56] References Cited

U.S. PATENT DOCUMENTS

| | | | |
|---|---|---|---|
| D. 228,563 | 10/1973 | Brower | 273/167 D X |
| D. 232,316 | 8/1974 | Cook | 273/167 D X |
| D. 234,782 | 4/1975 | Creed | 273/163 R X |
| 1,556,062 | 10/1925 | Baugh | 273/163 R X |
| 1,646,819 | 10/1927 | Hutchinson | 273/164 X |
| 2,003,951 | 6/1935 | Pepin | 273/164 |
| 2,463,798 | 3/1949 | Paisley | 273/163 R |
| 2,842,369 | 7/1958 | East | 273/164 |
| 2,898,109 | 8/1959 | Williams | 273/163 R |
| 3,019,022 | 1/1962 | Ehmke | 273/163 R |
| 3,043,596 | 7/1962 | Ehmke | 273/163 R |
| 3,085,804 | 4/1963 | Pieper | 273/164 X |
| 3,118,678 | 1/1964 | Rohr | 273/194 R X |
| 3,333,854 | 8/1967 | White | 273/164 |
| 3,462,155 | 8/1969 | Pelz | 273/183 D X |
| 3,549,300 | 12/1970 | Pelz | 273/164 X |
| 3,880,430 | 4/1975 | McCabe | 273/164 X |
| 4,032,156 | 6/1977 | Clarke | 273/164 |
| 4,043,562 | 8/1977 | Shillington | 273/164 |

OTHER PUBLICATIONS

"Golf Digest"; Apr. 1974; p. 122.

*Primary Examiner*—Richard J. Apley
*Attorney, Agent, or Firm*—Nicholas J. Aquilino

[57] ABSTRACT

A golf putter having a one single alignment means at one single focal point on the clubhead to aid the user in properly positioning the club in a level plane including an alignment mark to determine the loft position of the club and an alignment mark to determine the lie position of the club. The alignment system is formed of a combination of fixed inner indicia and complementary outer indicia which are located on at least two different surfaces. The fixed inner indicia, which is the dominant central image, has at least two directional marks with one mark being parallel and the other mark being perpendicular to the ball striking face. The complementary outer indicia is vertically spaced to interface with the inner indicia to create a visual in-line extension of the dominant central image appearing as one enlarged image when the clubhead is properly soled thereby providing a single sighting image for the proper positioning of the club with respect to loft and lie.

16 Claims, 10 Drawing Figures

GOLF CLUB ALIGNMENT SYSTEM

CROSS-REFERENCE TO RELATED APPLICATION

This application is a continuation-in-part application of Ser. No. 649,897, filed Jan. 16, 1976 now abandoned.

This invention relates to improvements in golf clubs and, in particular to golf putters having an alignment system to insure the club is properly positioned before a stroke is made.

Inadvertently, many golfers improperly position their putter before attempting a stroke. For example, a common fault is not positioning the club level with the ground before a stroke is attempted. The club may be placed so as to have too much or too little loft. This normally occurs when the user holds his hands too far in front of or behind the ball. Also, the club may be positioned so as to have the improper lie, that is, it may rest on either the toe or heel of the club rather than on the sole of the clubhead. Any stroke started with the club improperly positioned increases the risk of an improper stroke of the ball. Correcting the position of the clubhead during a stroke in order to propel it on its intended line of flight, requires more movement of the clubhead during the stroke than is necessary and, accordingly, the stroke is made more difficult to execute properly. If no adjustment is made during the stroke, the ball will be projected off-line or mis-hit to the degree that the club was originally misaligned. Improper soling of the clubhead may cause the clubhead to scuff the ground causing a twisting of the club and lessening of the impact of the stroke as well as increasing the chance of the club turning during the stroke.

Previous attempts to provide alignment devices on golf putters have resulted in either clubs with complicated and distracting reference marks or with reference marks providing only one of two required alignment factors necessary for proper alignment of the club.

It is, therefore, an object of the present invention to provide an alignment system for golf club putters which will permit easy and accurate positioning of the club at the start of the golf stroke.

It is a further object to provide an alignment system on the club which will insure the club is maintained in the same relative position at the start of each stroke played thereby aiding the golfer in developing a more consistent stroke by having a similar reference starting position each time a stroke is attempted.

It is another object to provide a single, simply constructed alignment system which will aid a golfer in placing the club level with the ground with respect to both loft and lie while requiring only one visual reference point.

In accordance with the present invention, the foregoing objects of the invention are attained by providing a golf putter having one single alignment system to aid the user in positioning the clubhead properly in both the loft and lie directions. The alignment system includes a combination of fixed indicia and complementary outer indicia which are located on at least two different surfaces and at least in two different directions with respect to the clubface. The complementary outer indicia is vertically spaced to interface with the inner indicia to create a visual in-line outwardly radiating extension of the dominant central image. This alignment system permits the sighting marks to intersect and form a cross hair pattern or reticle type aligning image, thereby providing a single reference point for the proper positioning of the club with respect to loft and lie. Improper alignment of the club will cause one or both of the alignment marks not to interface. Using this aligning system, the dominant inner image is substantially enlarged when the club is properly aligned.

The subject invention and its unique alignment features can best be understood by referring to the following description thereof together with reference to the accompanying drawings.

DETAILED DESCRIPTION OF THE PREFERRED EMBODIMENTS

Figure 1:
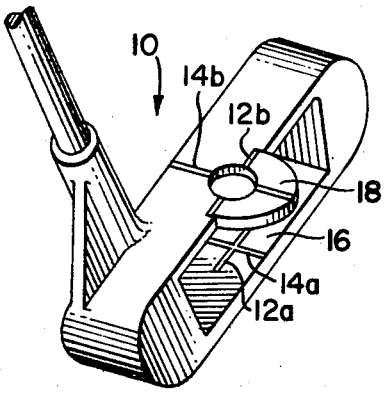
FIG. 1 is a perspective view of a golf clubhead and alignment system with the club shaft being shown fragmentarily.

Referring to FIGS. 1 to 4 of the drawings, one embodiment of the golf clubhead 10 and alignment system is shown; whereas particular clubhead configurations are shown, it will be appreciated that any shape clubhead suitable for carrying the alignment system may be used.

The alignment system is formed of an alignment mark 12 to determine the loft position and an alignment mark 14 to determine the lie position of the club. Each of the alignment marks 12 and 14 are formed of a fixed inner indicia and a complementary outer indicia which are vertically spaced from each other. As seen in the drawing, loft alignment mark 12 is formed of fixed inner indicia **12*a* and complementary outer indicia 12*b* and lie alignment mark 14 consists of fixed inner indicia 14*a* and complementary outer indicia 14*b***.

The alignment marks 12 and 14 are formed at right angles to each other. The loft alignment mark 12 is parallel to the clubface whereas the lie alignment mark 14 is perpendicular to the clubface. In the preferred embodiment shown, the fixed indicia **12*a* and 14*a* intersect to form a reticle or crosshair pattern which acts as a central dominant image. The fixed indicia 12*a* and 14*a* are located on a lower flange 16 of the clubhead 10. The complementary outer indicia 12*b* and 14*b* are positioned outside of the inner indicia and are located on an upper surface or extension 18 of the clubhead which is vertically spaced from the fixed central image. This extension 18 includes an opening through which the central dominant image, formed of indicia 12*a* and 14*a***, is viewed. The opening is shown as being round but it will be appreciated the hole may be square, or any other convenient shape.

Figure 2:
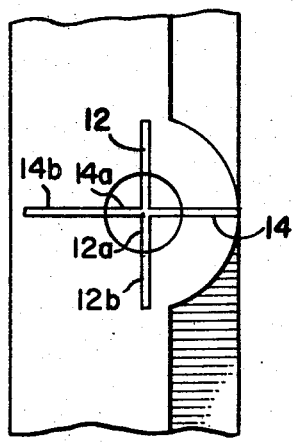
FIG. 2 is a top plan view of a cut-away fragmentary portion of the clubhead.

When the clubhead 10 is properly positioned as shown in FIG. 2, the complementary outer indicia **12*b* and 14*b* interface with the dominant central image 12*a* and 14*a*** which project outwardly in both directions to form a visual in-line outwardly radiating extension of the dominant central image thereby enlarging it to provide an immediate indication that the clubhead is properly aligned. Therefore, both loft and lie alignment can be accomplished using a single sighting image at one single focal point on the clubhead.

Figure 3:
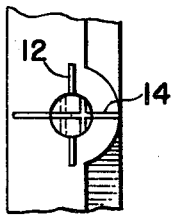
FIGS. 3 and 4 are alternate views of FIG. 2 showing the operation of the alignment system.
Figure 4:
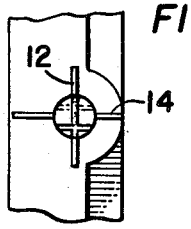

The operation of the alignment system is more clearly seen in FIGS. 3 and 4. As shown in FIG. 3, the clubhead is improperly positioned with respect to loft only. The alignment mark 12 in the vertical direction appears non-continuous or broken because the clubhead 10 is positioned so that the angle of the loft of the club has been substantially decreased. This causes the lower portion of the mark to shift to the right because of the vertical distance between the inner and outer portions of the alignment mark. If the angle of the loft of the clubhead is increased, the lower portion of the vertical alignment mark would shift to the left as shown in dotted lines in the drawing. The alignment mark 14 for the lie of the clubhead is shown in alignment in FIG. 3.

FIG. 4 shows the clubhead improperly positioned only with respect to the lie of the clubhead and the horizontal alignment mark 14 appears broken and non-continuous. The drawing shows the clubhead with a lie that is too upright so that the clubhead rests on its toe and lower portion of the mark 14 shifts below normal because of the relative vertical distance between the two portions of the mark 14. Conversely, if the lie of the clubhead is too flat, causing the clubhead to sit on its heel, the lower portion of the alignment mark will shift above normal as shown in dotted lines in the drawing. The loft alignment mark 12 is shown in alignment in FIG. 4.

It will be appreciated that if both the loft and lie of the clubhead are misaligned, both alignment marks 12 and 14 will be shown broken and discontinuous. In any case, where the club is not properly aligned, the dominant central image does not interface with the complementary outer image to provide the enlarged image.

Figure 6:
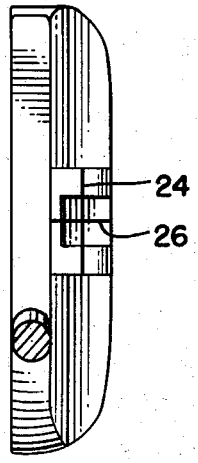
FIG. 6 is a top plan view of FIG. 5.
Figure 5:
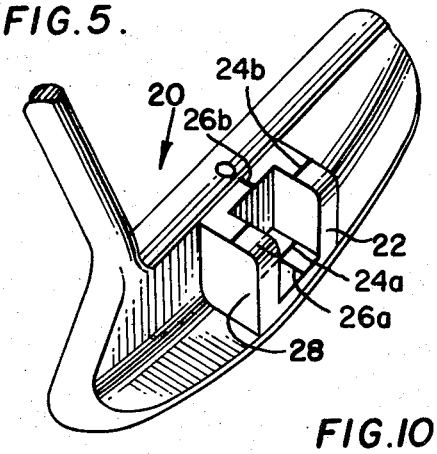
FIG. 5 is a perspective view of an alternate embodiment of the present invention.

Another embodiment of the alignment system is shown in FIGS. 5 and 6. A clubhead 20 includes an alignment device 22 which may be separately attached to the clubhead as well as made an integral part thereof. The device 22 is formed in the shape of a hollow box-like member with an open rear side. As with the system described in connection with FIGS. 1 to 4, two alignment marks 24 and 26 are shown. The inner marks **24*a* and 26*a* lie on the lower surface of the clubhead 20 whereas the outer portion of the alignment marks 24*b* and 26*b* are formed on the upper surfaces of the walls 28 of the device 22. The walls 28** extend rearwardly from the back of the clubface and also serve as a glare shield for the central alignment marks.

It will be appreciated the alignment marks are used in the same way as described for the marks of FIGS. 1 to 4.

Although the horizontal portion **26*a* of the fixed indicia interfaces with one complementary indicia 26*b*, the principle remains the same because the image is enlarged when the lines 26*a* and 26*b*** interface as the club is aligned.

Figure 7:
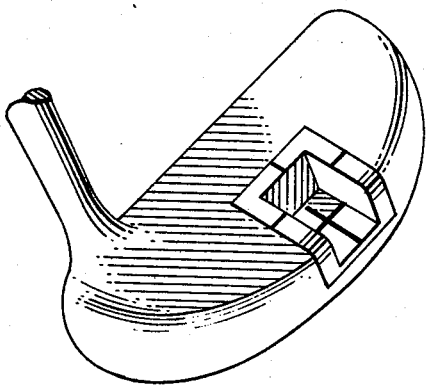
FIGS. 7 and 8 show the alternate embodiment of FIG. 5 on different type clubheads.
Figure 8:
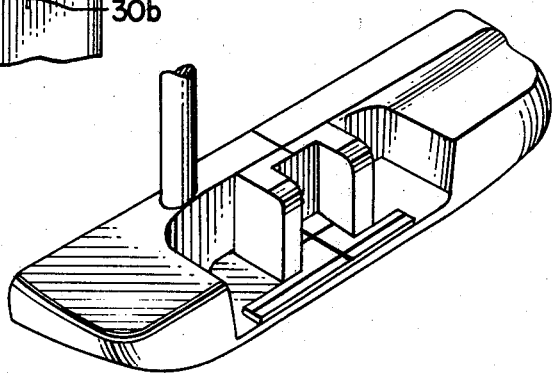

FIGS. 7 and 8 show examples of alternate clubheads with which the alignment system may be used. FIG. 7 shows an alignment system having a structure similar to the embodiment shown in FIGS. 5 and 6 wherein the complementary outer indicia is positioned approximately the same level as the top of the clubhead. FIG. 8 shows an alignment system which includes an additional line parallel to the clubface.

The specific shapes or designs of the alignment system are not critical, and it may be used as an attachment or made as an integral part of the club. Only one complementary outer indicia is necessary to enlarge the dominant central image when the club is properly aligned. Also, the alignment marks need not be shown as continuous lines. The invention would function equally as well using a series of dashes, dots or other geometrical shapes as long as they provide the appearance of an in-line extension of the dominant central image when the club is properly aligned or a broken line of indicia which would not enlarge the dominant image when they are improperly aligned.

Figure 9:
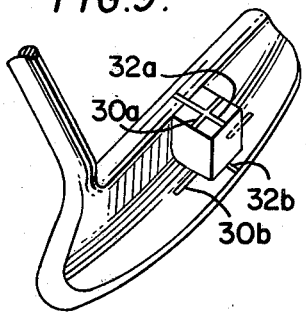
FIG. 9 is a perspective view of another alternate embodiment of the invention.
Figure 10:
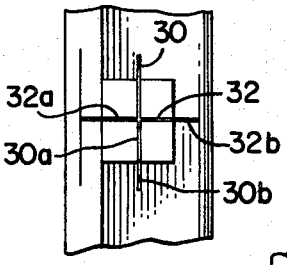
FIG. 10 is a partial, top plan view of the embodiment of FIG. 9.

FIGS. 9 and 10 show still another embodiment of the present invention wherein the central dominant image is disposed on a plane higher than the plane of the complementary outer indicia of the alignment system. The use and operation is the same as the alignment system of FIGS. 1 to 4. The indicia **30*a* and 32*a* positioned at right angles in a crosshair configuration on an upper flange of the clubhead form the dominant central image. The complementary outer indicia 30*b* and 32*b*** are positioned on a lower flange of the clubhead and form an enlarged image with the central image when the clubhead is properly aligned.

Inasmuch as the present invention is subject to many variations, modifications and changes in detail, it is intended that all matter described above or in the accompanying drawings be interpreted as illustrative and not in a limited sense.

What is claimed is:

1. A golf clubhead of the putter type having a putter blade with a frontal striking face, a rear face and at least one upper surface and at least one lower surface comprising;

one single visual precision alignment means creating one single sighting image at one single focal point for providing both lie and loft alignment of said clubhead including:

(a) inner indicia located on one of said surfaces forming a dominant central image having at least two inner directional marks, one of said marks being parallel to said striking face and a second of said marks being perpendicular to said striking face, (b) outer indicia positioned outside of said inner indicia and located on the other of said surfaces vertically spaced from and complementary to said inner indicia, said outer indicia having at least one outer directional mark in the same linear direction as each of said two inner directional marks, one of said outer marks being parallel to said striking face and a second of said outer marks being perpendicular to said striking face, and (c) said inner indicia extend outwardly to interface with said complementary outer indicia creating a visual in-line outwardly radiating extension of said dominant central image appearing as one enlarged image when said inner indicia and said outer indicia are interfaced clearly presenting a single sighting image at one single focal point so that the user may establish precision alignment for both lie and loft indicating when the clubhead is properly soled.

2. The golf clubhead of claim 1 wherein said two directional marks on said inner indicia form a reticle type alignment image.

3. The golf clubhead of claim 2 wherein said two directional marks of said inner indicia form a cross hair type alignment image.

4. The golf clubhead of claim 1 wherein said two inner directional marks of said inner indicia are both disposed on the same surface.

5. The golf clubhead of claim 4 wherein said outer directional marks of said outer indicia are both disposed on the same surface.

6. The golf clubhead of claim 1 wherein said two inner directional marks on said inner indicia extend outwardly from the center of said dominant central image.

7. The golf clubhead of claim 1 further including a cavity formed of walls and said lower surface, said inner indicia being located on said lower surface and said complementary outer indicia being located on said upper surface adjacent said walls.

8. The golf clubhead of claim 7 wherein said walls include vertical flanges extending rearwardly from said frontal face, said upper surface including the top surface of said vertical flanges and said lower surface including a horizontal flange extending rearwardly from said clubface.

9. The golf clubhead of claim 8 further including an additional alignment mark parallel to and rearward of said frontal face located on said lower horizontal flange, said additional alignment mark perpendicular to the portion of said inner indicia extending from said frontal face, forming a T image.

10. The golf clubhead of claim 1 wherein said upper surface includes said inner indicia and said lower surface includes said outer indicia.

11. The golf clubhead of claim 10 wherein said upper surface includes an extension rearwardly from said frontal face.

12. The golf clubhead of claim 10 wherein said lower surface includes an extension rearwardly from said frontal face.

13. The golf clubhead of claim 1 wherein said upper surface includes a first horizontal flange extending rearwardly from said frontal face and on which is located said outer indicia and said lower surface includes a second horizontal flange on which is located said inner indicia.

14. The golf clubhead of claim 13 wherein said first horizontal flange includes an opening through which said inner indicia is viewed for alignment.

15. The golf clubhead of claim 13 further including walls extending rearwardly from said frontal face connecting said first and second horizontal flanges, said flanges and walls defining a gravity rearwardly of said frontal face.

16. The golf clubhead of claim 1 wherein said lower surface includes a first horizontal flange extending rearwardly from said frontal face and said upper surface includes a second horizontal flange extending rearwardly from said frontal face, said inner indicia being located on said first horizontal flange, said outer indicia being located on said second horizontal flange, said second horizontal flange including an opening which substantially surrounds said inner indicia when said inner indicia is viewed through said opening.

* * * * *